US007395615B2

(12) United States Patent
Lee

(10) Patent No.: US 7,395,615 B2
(45) Date of Patent: Jul. 8, 2008

(54) PUMPING DEVICE OF SHOES

(75) Inventor: Kwangsoo Lee, Busan (KR)

(73) Assignee: Pispos Co., Ltd., Pusan (KR)

( * ) Notice: Subject to any disclaimer, the term of this patent is extended or adjusted under 35 U.S.C. 154(b) by 360 days.

(21) Appl. No.: 10/564,240

(22) PCT Filed: May 21, 2004

(86) PCT No.: PCT/KR2004/001198

§ 371 (c)(1),
(2), (4) Date: Jan. 11, 2006

(87) PCT Pub. No.: WO2005/004657

PCT Pub. Date: Jan. 20, 2005

(65) Prior Publication Data

US 2006/0196081 A1 Sep. 7, 2006

(30) Foreign Application Priority Data

Jul. 12, 2003 (KR) ..... 10-2003-0047493

(51) Int. Cl.
*A43B 13/20* (2006.01)

(52) U.S. Cl. ..... 36/29; 36/3 B

(58) Field of Classification Search ..... 36/29, 36/3 B, 3 R

See application file for complete search history.

(56) References Cited

U.S. PATENT DOCUMENTS 4,860,463 A * 8/1989 Pin ..... 36/3 B
5,025,575 A 6/1991 Lakic
5,477,626 A * 12/1995 Kwon ..... 36/3 B
5,846,063 A 12/1998 Lakic
5,918,383 A 7/1999 Chee
6,014,823 A 1/2000 Lakic
6,510,624 B1 * 1/2003 Lakic ..... 36/29

FOREIGN PATENT DOCUMENTS

KR 1019960036970 11/1996
KR 20-0196729 9/2000
WO WO 95/13718 5/1995

* cited by examiner

*Primary Examiner*—Ted Kavanaugh
(74) *Attorney, Agent, or Firm*—IPLA P.A.; James E. Bame

(57) ABSTRACT

The present invention discloses a pumping device of a shoe 100 includes a cushion body (110) formed inside a sole of the shoe (110) and having front and back air chambers (120 and 130) formed therein in such a manner as to be disposed at the front and back portions thereof; an automatic pump (140) mounted adjacent to the back air chamber (130) in such a manner as to communicate with the back air chamber (130) and having a height (H2) higher than a height (H1) of the back air chamber (130); a suction valve (150) and a check valve (160) mounted at the front and back sides of the automatic pump (140); and a pressure adjusting valve (170) formed at a connecting valve (125) for connecting the back air chamber (130) with the front air chamber (120).

5 Claims, 5 Drawing Sheets

[Fig. 1]
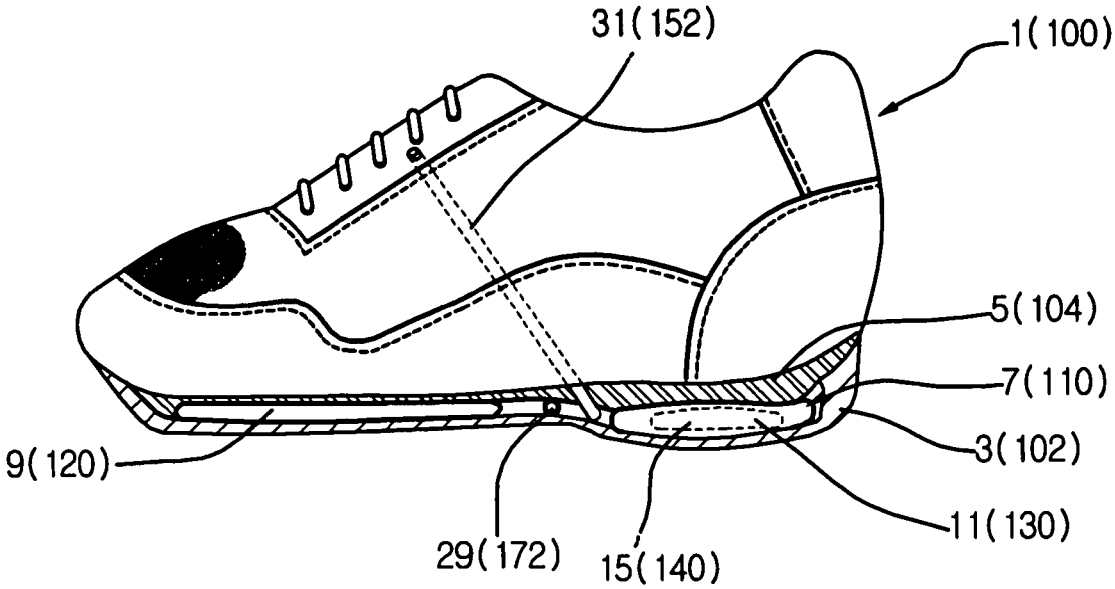

[Fig. 2]
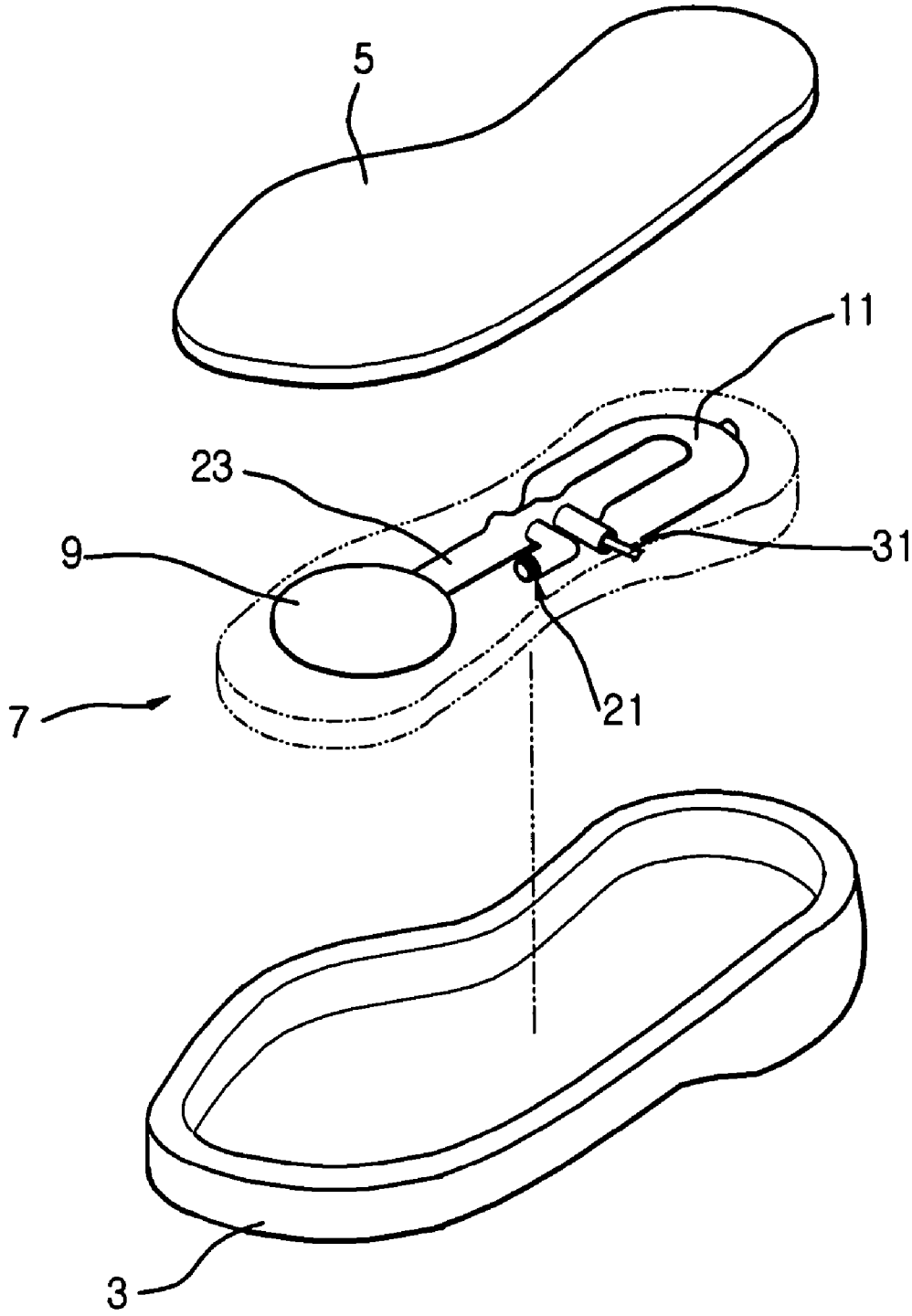

[Fig. 3]
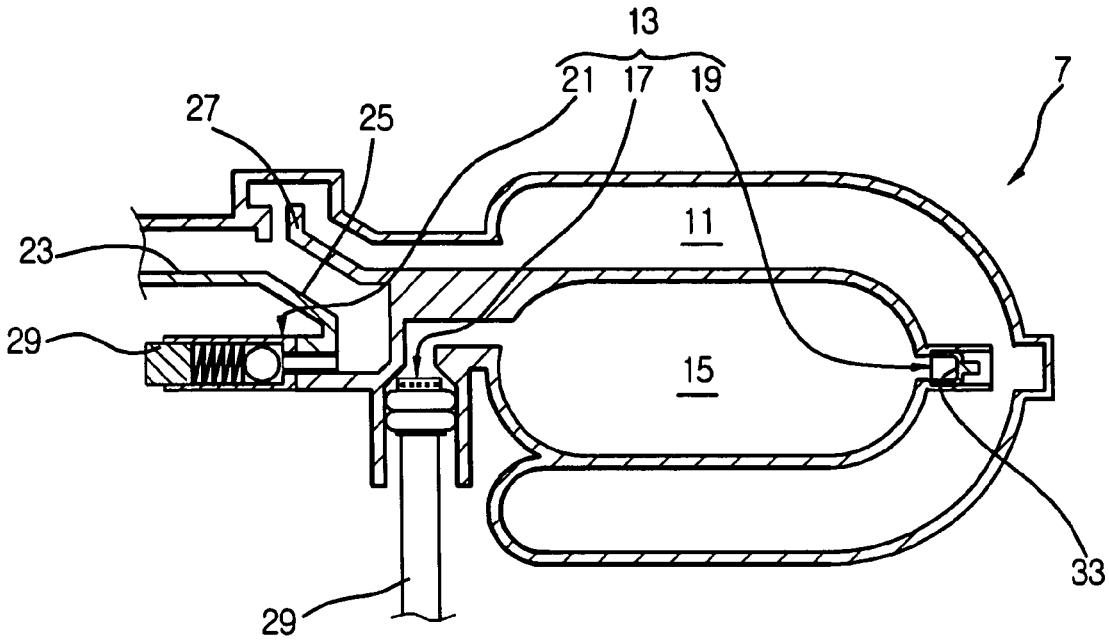

[Fig. 4]
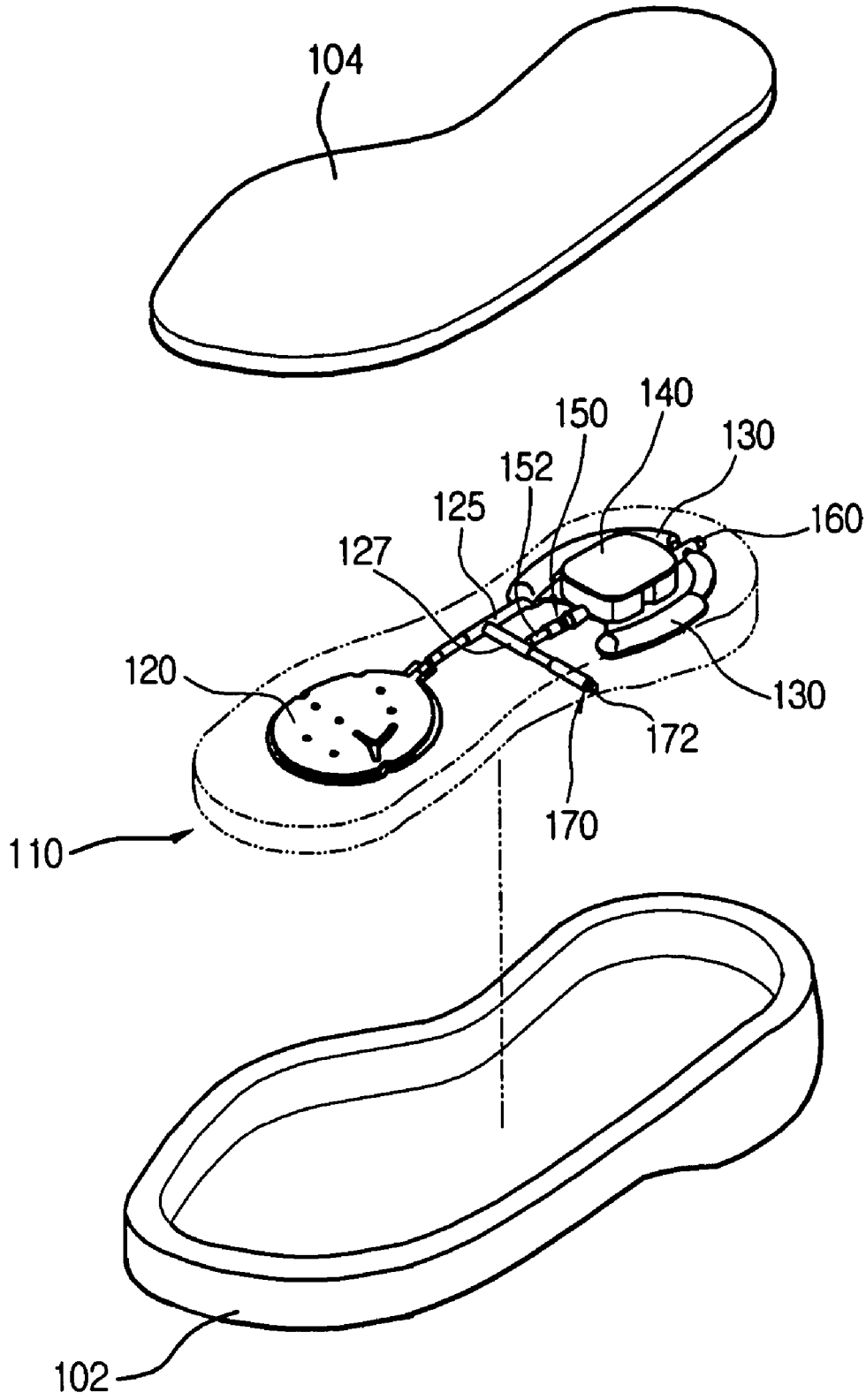

[Fig. 5]
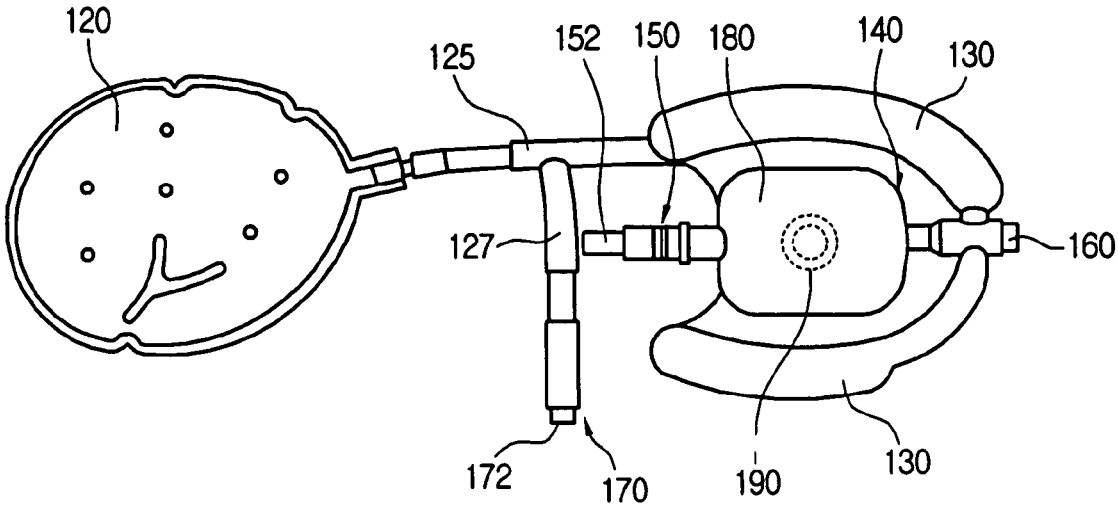
[Fig. 6]
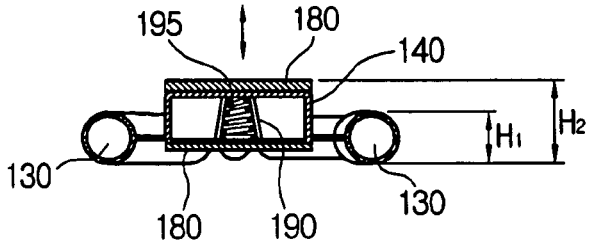

PUMPING DEVICE OF SHOES

TECHNICAL FIELD

The present invention relates to a pumping device of a shoe.

BACKGROUND ART

As well known, generally, shoes for absorbing shocks applied thereto are worn to reduce the shocks occurring when a wearer walks or exercises and thus to keep his walking or exercising at more stable positions, which prevents his fatigue from getting serious, and when the shoes are worn, the shocks are all absorbed such that the wearer can previously avoid the generation of the troubles in his knee joints.

FIGS. 1 to 3 show one example of conventional shock absorbing shoes (which is disclosed in Korean Utility Model Registration No. 20-0196729). As shown in the drawings, a pumping device of the conventional shock absorbing shoe 1 includes a shoe 1 includes a cushion body 7 that is disposed between an cuter sole 3 and a middle sole 5 of the shoe 1, for absorbing shocks in accordance with the variation of the pressure applied from a wearer's feet and that has front and back air chambers 9 and 11 formed in the cushion body 7 in such a manner as to be disposed at the front and back portions of the cushion body 7, respectively, for sucking air from the outside and exhausting the air filled in the interior of the shoe 1 to the outside, and an air pressure adjusting assembly 13 that is adapted to control streams of airflow of the front and back air chambers 9 and 11.

The air pressure adjusting means 13 includes: an automatic pump 15 that is provided with a suction valve 17 at one side thereof for sucking air from the outside therethrough, and with a check valve 19 that communicates with the back air chamber 11 and exhausts air to the inside of the back air chamber 11, at the other side thereof; and a pressure adjusting valve 21 that is connected to a connecting tube 23 for connecting the front air chamber 9 with the back air chamber 11 and is disposed at an exhaust tube 25 that is adapted to exhaust the air in the front and back air chambers 9 and 11 to the outside. The connecting tube 23 is provided with a Side protrusion piece 27 that is adapted to guide the air in the front air chamber 9 to the exhaust tube 25, at a central portion thereof, and the automatic pump 15 is operated by the pressure applied from a wearer's foot. The automatic pump 15 and the front and back air chambers 9 and 11 are formed to the same height for the sake for convenience at a time of manufacturing.

The suction valve 17 serves to suck the air from the outside and to move the air to the interior of the automatic pump 15, and the check valve 19 serves to exhaust the air to the back air chamber 11 by means of the pressure of the automatic pump 15. The pressure adjusting valve 21 is operated in such a manner that the air in the front air chamber 9 is exhausted to the outside by means of the pressure of shocks, thereby implementing the circulation of air between the inside and outside of each of the front and back air chambers 9 and 11.

Under the above construction, as the front and back portions of the outer sole 30 are sequentially depressed by the pressure applied from the wearer's foot, the automatic pump 15 operates to suck the air from the outside to the back air chamber 11. Thus, the air in the back air chamber 11 is moved to the front air chamber 9 by the pressure of the wearers foot and by the air exhausted from the check valve 19. As a result, the air in the front air chamber 9 is exhausted to the outside via the pressure adjusting valve 21 by the pressure of shocks applied to the shoe 1.

In this case, a reference numeral 29 that is not explained above denotes an adjusting body and 31 denotes a suction tube.

DISCLOSURE OF INVENTION

Technical Problem

In the conventional shock absorbing shoe, however, since the back air chamber 11 and the automatic pump 15 are designed to have the same height, the automatic pump 15 is normally pumped at its initial step, but if more than a predetermined pressure is applied, the back air chamber 11 and the automatic pump 15 become under the same pressure at the upper portion thereof, which reduces the pumping force or even fails to pump.

Technical Solution

Accordingly, the present inventor has been made to solve the above-described problems, and it is an object of the present invention to provide a pumping device of a shoe that has appropriate pumping through an automatic pump and absorbs shocks applied to the shoe in accordance with the variation of the pressure applied from a wearer's foot.

To accomplish the above object, according to the present invention, there is provided a pumping device of a shoe including: a cushion body formed inside a sole of the shoe and having front and back air chambers formed therein in such a manner as to be disposed at the front and back portions thereof; an automatic pump mounted adjacent to the back air chamber in such a manner as to communicate with the back air chamber and having a height (H2) higher than a height (H1) of the back air chamber; a suction valve and a check valve mounted at the front and back sides of the automatic pump; and a pressure adjusting valve formed at a connecting valve for connecting the back air chamber with the front air chamber.

DESCRIPTION OF DRAWINGS

Further objects and advantages of the invention can be more fully understood from the following detailed description taken in conjunction with the accompanying drawings, in which:

FIG. 1 is a side sectional view of a conventional pumping device of a shoe;

FIG. 2 is an exploded view of the pumping device of the shoe of FIG. 1;

FIG. 3 is an enlarged sectional view of the main parts of the pumping device of FIG. 1;

FIG. 4 is an exploded view of a pumping device of a shoe according to the present invention;

FIG. 5 is an enlarged sectional view of the main parts of the pumping device according to the present invention; and FIG. 6 is a side sectional view of the pumping device according to the present invention.

BEST MODE

Now, an explanation on the preferred embodiment of the present invention will be in detail given with reference to attached drawings.

As shown in FIGS. 4 to 6, there is provided a pumping device of a shoe 100 according to the present invention includes: a cushion body 110 that is disposed between an cuter sole 102 and a middle sole 104 of the shoe 100, for absorbing shocks in accordance with the variation of the pressure applied from a wearer's foot and that has front and back air chambers 120 and 130 formed therein in such a manner as to be disposed at the front and back portions of the cushion body 110, for sucking air from the outside and exhausting the air filled in the interior of the shoe 100 to the outside; an automatic pump 140 formed inside the back air chamber 130 in such a manner as to communicate with the back air chamber 130 and having a height H2 higher than a height H1 of the back air chamber 130; a suction valve 150 and a check valve 160 mounted at the front and back sides of the automatic pump 140, for allowing air to be sucked by the automatic pump 140 and moved to the back air chamber 130; and a pressure adjusting valve 170 mounted at a connecting valve 125 for connecting the back air chamber 130 with the front air chamber 120 to perform movement of air between the back air chamber 130 and the front air chamber 120.

The automatic pump 140 is formed to have the height H2 higher than the height H1 of the back air chamber 130, such that the pumping is carried cut through only the automatic pump 140.

The suction valve 150 at which air from the outside flows is placed at one side of the automatic pump 140, and the check valve 160 with which the back air chamber 130 communicates such that air is exhausted to the inside of the back air chamber 130 is placed at the other side of the automatic pump 140. Also, the pressure adjusting valve 170 is formed on an exhaust tube 127 that is connected to the connecting valve 125 connecting the back air chamber 130 with the front air chamber 120, for exhausting the air in the front and back air chambers 120 and 130 to the outside.

The automatic pump 140 is formed to have the height H2 higher than the height H1 of the back air chamber 130, such that as the automatic pump 140 is depressed by a wearers foot, the pumping is carried out. The automatic pump 140 is provided with a support plate 180 at the top and bottom sides thereof, respectively. When the automatic pump 140 is depressed, the support plates 180 function to delivery uniform pressure from the top and bottom sides to the inside thereof, such that variations of the internal pressure of the automatic pump 140 are evenly made, thereby improving the pumping force.

The automatic pump 140 is further provided with a support body 190 that is adapted to support the upper and lower sides of the interior of the automatic pump 140 against each other, at the inside thereof. Desirably, the support body 190 has a generally conical shape such that the pressure is appropriately sent from the upper side of the automatic pump 140 to the lower side thereof.

Also, the support body 190 selectively has a restoring spring 195 disposed at the inside thereof, and in this case, the restoring spring 195 is formed in such a manner as to be in contact with the top and bottom sides of the automatic pump 140, at the top and bottom sides thereof. The formation of the restoring spring 195 enables the automatic pump 140 to be rapidly restored to its original state at its compressed state.

When the restoring spring 195 is provided inside the support body 190, the pumping process of the automatic pump 140 is carried out rapidly and regularly. During the pumping, also, the pressure is sent uniformly through the support plates 180.

In this case, a reference numeral 172 that is not explained above denotes an adjusting member and 152 denotes a suction tube.

According to the present invention, the pumping is appropriately conducted by the automatic pump of the shoe, thereby achieving the absorption of shocks in accordance with the pressure applied from the wearer's fool. The automatic pump 140 is formed to the higher height H2 than the back air chamber 130, and the support plates 180 are attached on the top and bottom sides of the automatic pump 140. Additionally, the support body 190 is provided inside the automatic pump 140, such that the upper and lower sides of the interior of the automatic pump 140 are firmly supported The support body 190 has the generally conical shape and when the automatic pump 140 is pressed by the wearer's foot, it can be appropriately compressed After the pressure of the foot is released, the automatic pump 140 is instantly returned to its original state by means of the restoring spring 195 that is provided inside the support body 190.

Under the above construction, if the shoe 100 is worn on the wearer's foot, the automatic pump 140 is pressed by his foot, and it starts to be compressed such that the air in the automatic pump 140 is exhausted to the back air chamber 120 via the check valve 160. Thus, the air flowing into the back air chamber 130 flows into the front air chamber 120. If the pressure of the wearer is not sent to the automatic pump 140, the automatic pump 140 is returned to its original state by means of the support body 190 and the restoring spring 195, and when the automatic pump 140 is expanded, the air from the outside is automatically sucked through the suction valve 150. If the automatic pump 140 is compressed again by the wearer's foot, the air from the outside is sucked to flow into the front and back air chambers 120 and 130.

If the front and back air chambers 120 and 130 reach a set value of pressure, the air in them is exhausted to the outside through the pressure adjusting valve 170, and as the stream of airflow is formed through the front and back air chambers 120 and 130 and the pressure adjusting valve 170, the shoe 100 can absorb the shock applied thereto and change the internal air into fresh air.

When the pressure of the wearer is sent to the automatic pump 140, the automatic pump 140 is supported by means of the support plates 180 on the top and bottom sides thereof, with a result that the pressure can be uniformly sent to the automatic pump 140. As a result, the automatic pump 140 can operate at a better condition.

Also, the automatic pump 140 and the support plates 180 are supported by means of the support body 190 that is provided inside the automatic pump 140, such that the pumping force can be greatly improved, and when the automatic pump 140 is pumped, the pressure of the wearer is not sent above the back air chamber 130 that is formed around the automatic pump 140, such that even though the pressure in the front and back air chambers 120 and 130 reaches more than a predetermined value, the pumping can be appropriately conducted.

On the other hand, the pressure adjusting valve 170 is adjusted in accordance with the pressure of the wearer's foot and the variation of temperature, which enables the shocks applied to the shoe to be optimally absorbed. In addition, the air from the outside is automatically supplied to the cushion body 110 and the air in the cushion body 110 is exhausted to the outside, which enables the bad smell that may be generated inside the shoe 100 to completely disappear.

INDUSTRIAL APPLICABILITY

As set forth in the foregoing, the pumping device of the shoe according to the present invention is provided with the automatic pump that is formed to a higher height than the back air chamber such that the pressure of the wearer is sent not to the back air chamber, but to the automatic pump, thereby improving the pumping force of the automatic pump.

The support plates are formed on the top and bottom sides of the automatic pump and the support body is formed inside the automatic pump, such that when the pressure of the wearer is sent to the automatic pump, the automatic pump can be uniformly compressed and expanded, thereby achieving the uniform pumping of the automatic pump.

Additionally, the support body has the general conical shape, which enables the compression force of the automatic pump to be uniformly applied, and the restoring spring is provided inside the support body, which enables the automatic pump to be returned rapidly to its original state after the compression.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A pumping device of a shoe (100) comprising:

a cushion body (110) formed inside a sole of the shoe (110) and having front and back air chambers (120 and 130) formed therein in such a manner as to be disposed at the front and back portions thereof;

an automatic pump (140) mounted adjacent to the back air chamber (130) in such a manner as to communicate with the back air chamber (130) and having a height (H2) higher than a height (H1) of the back air chamber (130);

a suction valve (150) and a check valve (160) mounted at the front and back sides of the automatic pump (140) respectively; and a pressure adjusting valve (170) formed at a connecting valve (125) for connecting the back air chamber (130) with the front air chamber (120).

2. The pumping device according to claim 1, wherein the automatic pump (140) has a support plate (180) disposed on the top and bottom sides thereof, respectively.

3. The pumping device according to claim 1, wherein the automatic pump (140) has a support body (190) disposed at the inside thereof.

4. The pumping device according to claim 3, wherein the support body (190) has a generally conical shape.

5. The pumping device according to claim 3, wherein the support body (190) has a restoring spring (195) disposed at the inside thereof, to be in contact with the top and bottom sides of the interior of the automatic pump (140), at the top and bottom sides thereof.

* * * * *